United States Patent [19]

Mitter

[11] Patent Number: 4,475,455

[45] **Date of Patent: * Oct. 9, 1984**

[54] TUBULAR STENCIL UNIT FOR SCREEN PRINTING

[76] Inventor: Mathias Mitter, Falkenstr. 57, 4815 Schloss Holte, Fed. Rep. of Germany

[ * ] Notice: The portion of the term of this patent subsequent to May 17, 2000 has been disclaimed.

[21] Appl. No.: 435,896

[22] Filed: Oct. 22, 1982

Related U.S. Application Data

[62] Division of Ser. No. 182,325, Aug. 28, 1980, Pat. No. 4,383,481.

[30] Foreign Application Priority Data

Sep. 6, 1979 [DE] Fed. Rep. of Germany ..... 2936003

[51] Int. Cl.[3] ..... B41L 13/04

[52] U.S. Cl. ..... 101/116; 101/127.1; 101/375

[58] Field of Search ..... 101/116, 118, 120, 127.1, 101/126, 375, 117

[56] References Cited

U.S. PATENT DOCUMENTS

| | | | |
|---|---|---|---|
| 1,718,886 | 6/1929 | Zeuthen | 101/118 |
| 2,016,868 | 10/1935 | McBean | 101/118 X |
| 3,495,285 | 2/1970 | Zimmer | 101/116 X |
| 3,599,565 | 8/1971 | Feier et al. | 101/116 |
| 3,881,413 | 5/1975 | Mitter | 101/127.1 |
| 3,958,507 | 5/1976 | Mitter | 101/126 |
| 3,992,994 | 11/1976 | Mitter | 101/116 X |
| 4,383,481 | 5/1983 | Mitter | 101/116 |

*Primary Examiner*—Edgar S. Burr
*Assistant Examiner*—Moshe I. Cohen
*Attorney, Agent, or Firm*—Peter K. Kontler

[57] ABSTRACT

A rotary stencil unit for screen printing machines has a tubular stencil provided at its opposite axial ends with respective end rings. One or both of these end rings has in its circumferential wall one or more openings which afford radial or diagonal access to the interior of the respective end ring and to the adjacent end portion of the stencil.

3 Claims, 3 Drawing Figures

TUBULAR STENCIL UNIT FOR SCREEN PRINTING

This application is a division of application Ser. No. 182,325, filed 8/28/1980, now Pat. No. 4,383,481.

BACKGROUND OF THE INVENTION

The present invention relates to screen printing.

More particularly, the invention relates to screen printing machines.

Still more specifically, the invention relates to tubular stencil units of the type used in rotary screen printing machines.

Stencil units of the type in question are already known. They are in form of cylindrically shaped, tubular stencils or printing screens the axial ends of which are mounted on end rings. The end rings are journalled, and the unit is driven, in suitable manner for which a variety of solutions is known. Ink or other material to be applied by screen printing to a workpiece, is admitted into the interior of the tubular stencil and is squeezed out through the perforations of the stencil by a squeegee.

In these known units, access to the interior of the tubular stencil is possible only in the axial direction, i.e., by inserting tools or the like axially through the respective end ring or rings. For many applications this is sufficient; for many others, however, it is not. This is particularly true if, for example, the stencil and its end rings are disengaged from the drive means and are to be removed from the machine journals, or if parts located in the interior of the stencil must be adjusted, secured or otherwise worked upon.

SUMMARY OF THE INVENTION

It is, accordingly, an object of the invention to overcome the prior-art disadvantages.

A more particular object of the invention is to provide an improved tubular stencil unit in which any desired tools, and even load-lifting devices, can gain access to the interior of the unit in radial or diagonal direction of the unit.

In keeping with these objects, and with still others which will become apparent hereafter, one aspect of the invention resides in a tubular stencil unit for screen printing machines. Briefly stated, this unit may comprise a tubular stencil, and a pair of end rings at the respective axial ends of the stencil, at least one of said end rings having a peripheral wall provided with at least one continuous opening communicating with its interior and being so oriented as to afford access to the interior of the unit in a direction other than axially of the unit. The direction of access may be radial or diagonal. More than one opening may be provided, and in this case the openings may be spaced uniformly about the end ring circumference so that it is immaterial in what angular position the stencil unit happens to be when access is required. Access may then be had from above, from the side or from below.

Some end rings are units composed of a main annular section and an auxiliary annular section. If the end rings involved are of this type, one of the opening(s) may be provided between the two sections; the purpose is the same as described above. In addition, such a construction may make it easier to adapt the end ring unit to different drive systems. However, the opening(s) may be provided in the wall of the auxiliary section itself.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
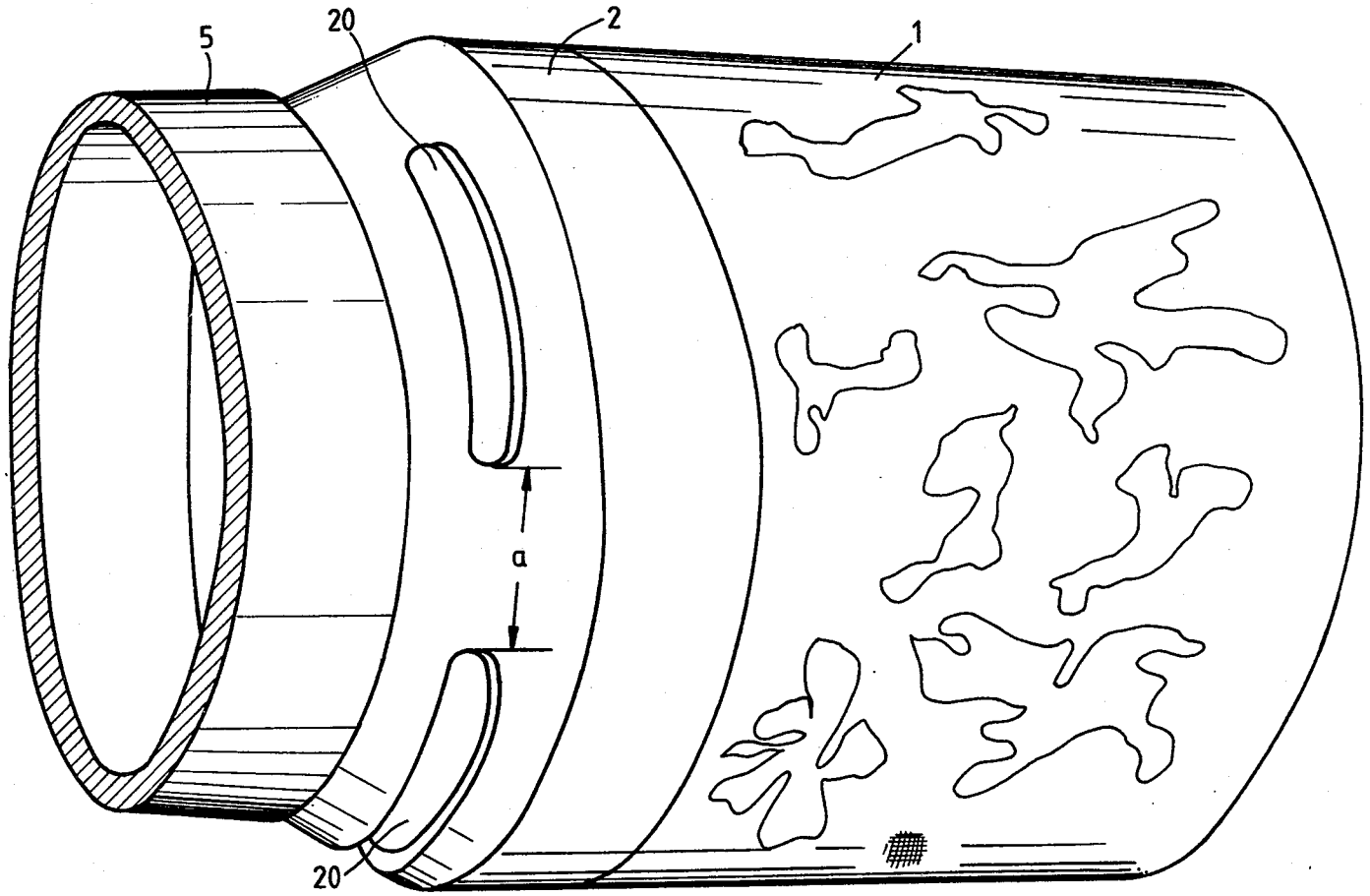
FIG. 1 is a fragmentary partly sectioned perspective, showing a tubular stencil and one end ring thereof.

A conventional tubular screen printing stencil is designated with reference numeral 1. Only one of its axial ends is visible, but it will be understood that each end is provided with an end ring 2; the end rings support the stencil 1 and mount it for rotation. There is nothing new about the stencil 1 per se.

In accordance with the invention at least one—but preferably each—of the end rings is provided in its circumferential wall with at least one continuous opening 20. However, as shown in FIG. 1 it is preferable to provide a plurality of the openings 20 and to distribute them equi-angularly about the ring circumference. In FIG. 1 the openings 20 are slot-shaped and oriented to afford access therethrough to the interior of the end ring in either radial or diagonal direction. Such access may be by hand (e.g., a worker inserting a tool) or by machine or the like. The openings 20 can be made large enough to offer a substantial degree of freedom of movement.

If several of the openings 20 are provided, successive ones of them should be spaced at a distance a which is so selected that the required mechanical strength of the end ring is not impaired. The longitudinal center lines of the openings 20 are aligned in a direction circumferentially of the end ring 2.

Figure 2:
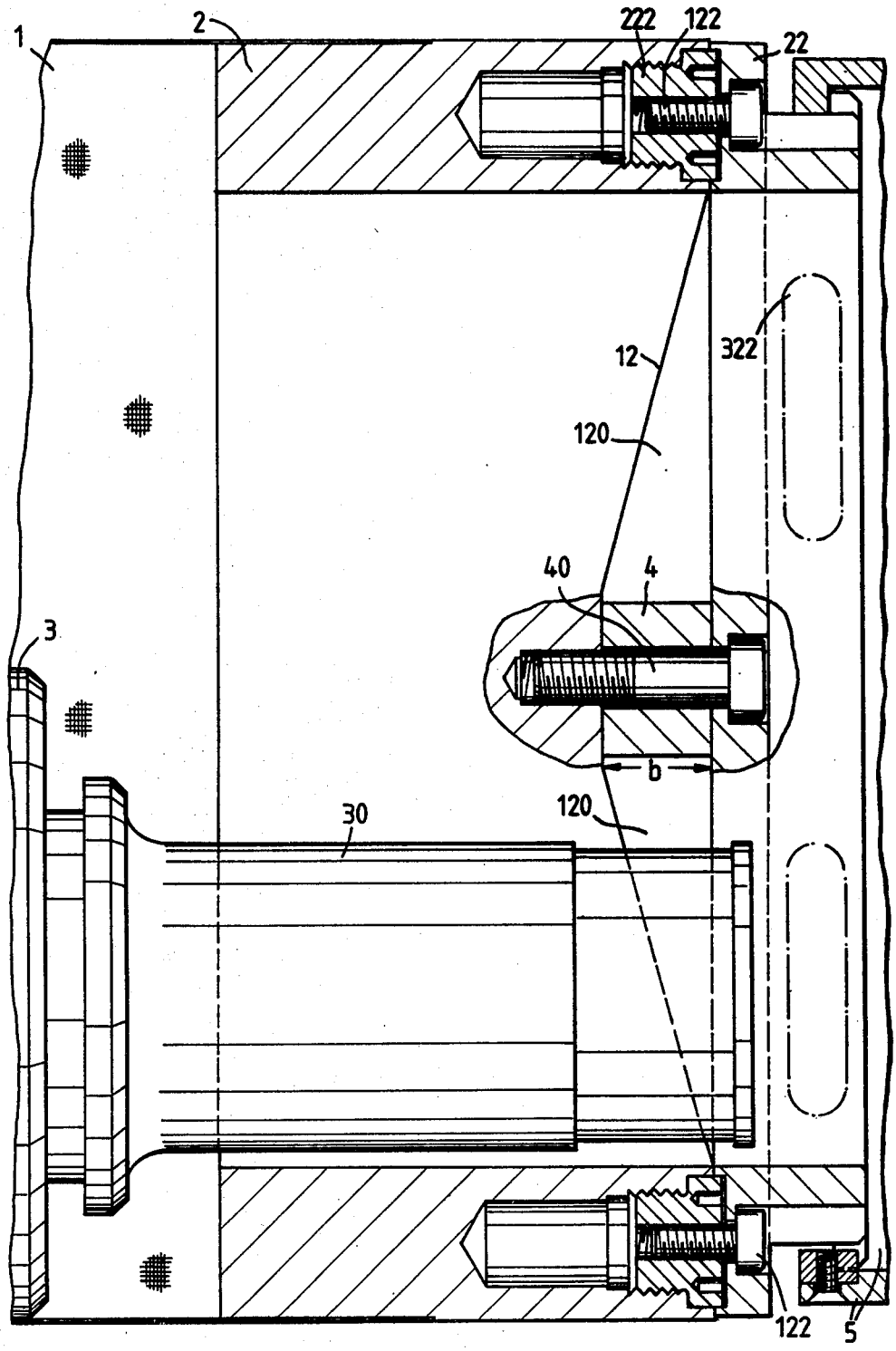
FIG. 2 is a fragmentary axial section through another embodiment.

It is clear that the openings 20 need not be slot-shaped, as shown in FIG. 1, but could have other shapes. Also, they need not be located on the tapered ring part as shown, but could be provided on the cylindrical ring part. What counts is that they offer sufficient access to the interior of the end rings and to the parts located therein. These parts are not visible in FIG. 1, but FIG. 2 shows a roller squeegee 3 the shaft end 30 of which is disengaged from its bearing and its drive. In addition to the roller squeegee, such parts may include a tube or other means for supplying ink, ink paste or other printing medium, devices for monitoring the medium pool located ahead of the squeegee roller, pump rollers, medium-pool limiters and the like. All of these elements were heretofore accessible only—and often only with great difficulty—in an axial direction through the central ring opening. Due to the invention they can now be reached in radial or diagonal direction, from whatever side of the end ring happens to be most convenient for access.

An end ring for a tubular stencil need not be a unitary structure but can—as is already known—be assembled of e.g., two annular components. Such as construction is shown in FIG. 2 where the end ring has the main annular part or component 2 and another annular component 22. The usual reason for choosing this type of end ring unit is the possibility which it offers to adapt the tubular stencil for operation with any desired type of drive system.

The annular components 2 and 22 may be connected to one another via screws or bolts 122 and e.g., threaded sleeves 222. In accordance with the invention, the component 12 itself may be provided with openings 322 (shown in broken lines) corresponding to the openings 20. In lieu of this (or even in addition thereto) inner openings 120 may be provided between the two components 2, 22 for radial or diagonal access to the interior. To create the openings 120 the larger (and hence stronger and more stable) component 2 may have its axial end face 12 recessed to create a spacing b from the juxtaposed end face of the component 22. This spacing is bridged by a support element, e.g., a sleeve 4, and a screw or bolt 40 connects the components 2,22 and sleeve 4 together. A ring 5 may be connected to the end ring unit (i.e., component 2 and/or 22) in any desired manner; it is shown in the drawing to symbolically indicate that the end ring unit can be connected (via ring 5) to any desired drive system.

Depending upon the location of the openings 120 with reference to the line of contact between the stencil 1 and the workpiece (the printing line), radial or diagonal access may be had via the respective openings to elements located in the interior of the end ring unit and in the end regions of the stencil 1, so that necessary work can be performed without difficulty. If the openings 120 need to be larger, the screws 40 can be backed off, sleeves 4 removed and components 2, 22 pulled or pushed axially apart until the openings 120 communicate circumferentially, i.e., until there is a circumferentially continuous gap between the components 2, 22. This is very simple and easy to do.

The recessing of the axial end face 12 of component 2 may be effected indentically at two diametrically opposite locations (or at pairs of such locations); respective ones of the sleeves 4 and bolts or screws 40 will then extend in parallelism with one another.

In this, as in the preceding embodiment, the shape and dimension of the openings 20, 120, 322 depend upon the construction of the respective end ring and, even more importantly, upon the sizes and types of tools to be inserted through the openings (see FIG. 3) and the space required to manipulate them in the interior. One or more of the openings may also be dimensioned to permit an operator to insert a hand or an arm.

One of the manipulations which can be carried out with the aid of the inventive construction, is to disengage the roller squeegee 3 (or other type of squeegee) from its mountings and its drive connection, to engage its shafts 30 at both ends with a lifting device, and to lift the squeegee (with the previously disconnected tubular stencil suspended on it) out from between the (not illustrated) end mounts. Other kinds of operations can, of course, also be performed.

Figure 3:
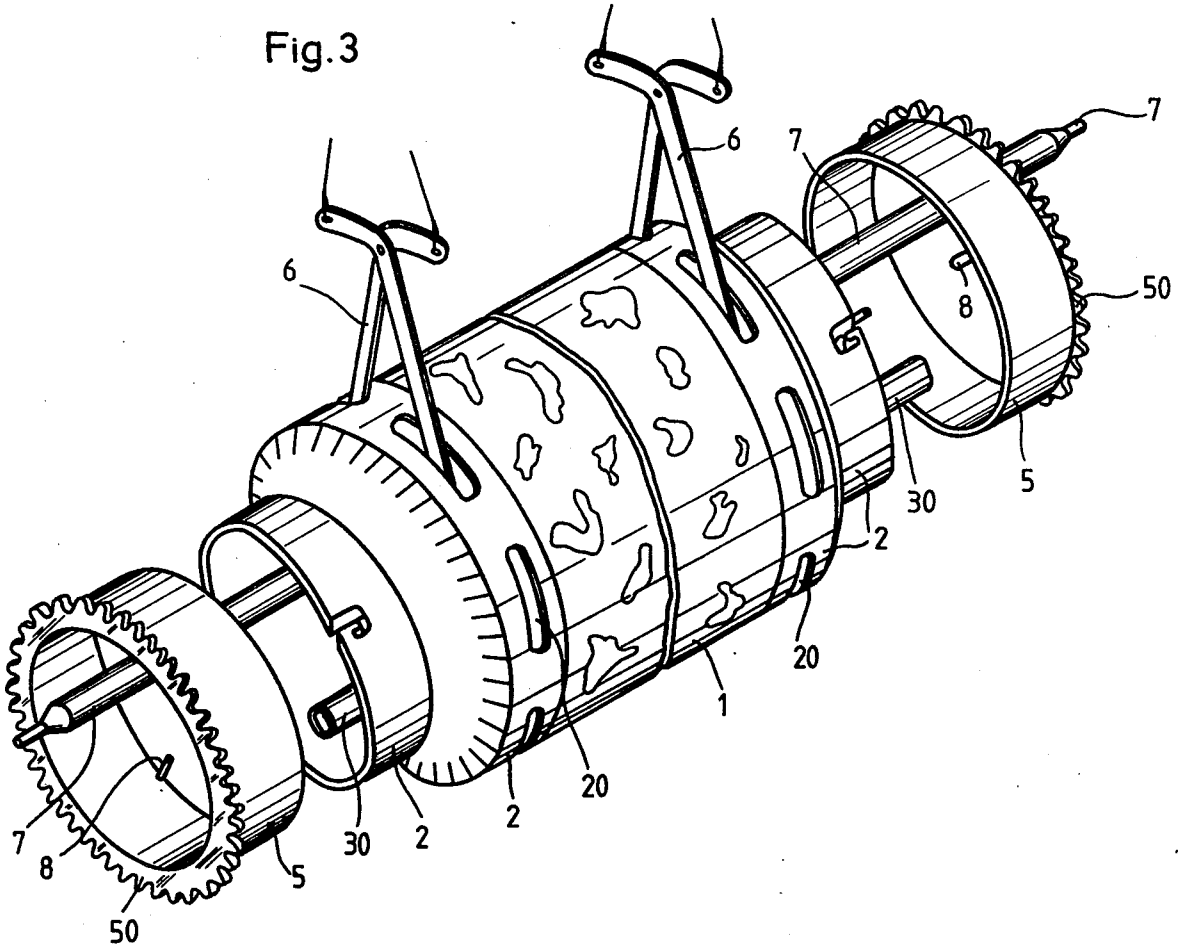
FIG. 3 is a perspective view, showing a tubular stencil with its end rings and drive.

FIG. 3, finally, illustrates jsut the type of operation mentioned above. Pivotable gripping tongs 6 are suspended from a not-illustrated load-lifting device and reach through the openings 20 into the interior of the end rings 2 where they engage around and beneath (not shown) the squeegee 3. The ink supply tube 7 must, of course, be disconnected. Two of the rings 5 are shown, provided with annuli of teeth 50 via which they can be driven in rotation; they can be telescoped over the smaller-diameter parts 2′ of the end rings 2 and be connected thereto via the pins 8 which enter into angled slots 8′ of the parts 2′. The rings 5 are journalled (not illustrated) in end mounts of any known type, for example of the type disclosed in U.S. Pat. No. 3,958,507.

While the invention has been illustrated and described as embodied in a screen printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a screen printing machine, the combination of a hollow tubular stencil having spaced apart axial end portions; a one-piece end ring directly connected to each of said end portions and coaxial with the respective end portion, each of said end rings including a circumferentially complete wall having a plurality of openings elongated in the circumferential direction provided in and fully surrounded by the material of the respective wall, said openings each being of a constant fixed size which does not vary during operation of the machine; a ring member releasably and rigidly secured to each end ring; drive means for rotating said stencil by way of at least one of said ring members; and a squeegee installed in the interior of said stencil, said squeegee being accessible to the working ends of tools which are insertable into the interior of the respective end rings by passing through the openings in said end rings in a direction substantially radially of the respective end portions so that such tools can engage said squeegee and support it for movement relative to said stencil or vice versa.

2. The combination of claim 1, wherein the several openings are equidistant from one another, as considered in the circumferential direction of the respective end rings.

3. The combination of claim 1, wherein said openings are spaced apart from one another, as considered in the circumferential direction of the respective end ring, and each of said end rings has uninterrupted portions between the neighboring openings.

* * * * *